United States Patent [19]

McSheffery

[11] Patent Number: 5,063,614

[45] Date of Patent: Nov. 12, 1991

[54] REVERSIBLE GARMENT HAVING DETACHABLE POCKETS

[76] Inventor: Kenneth E. McSheffery, R.D. 5 Box 156, Uniontown, Pa. 15401

[21] Appl. No.: 647,480

[22] Filed: Jan. 29, 1991

[51] Int. Cl.[5] ..... A41D 13/00; A41D 27/20

[52] U.S. Cl. ..... 2/94; 2/102; 2/247

[58] Field of Search ..... 2/46, 48, 49 R, 50, 2/51, 88, 93, 94, 102, 247, 250; 224/227

[56] References Cited

U.S. PATENT DOCUMENTS

| | | | |
|---|---|---|---|
| 262,577 | 8/1882 | Day | 2/94 |
| 314,333 | 3/1885 | Heller | 2/94 X |
| 1,135,833 | 4/1915 | Morse | 2/50 X |
| 1,520,962 | 12/1924 | North | 2/94 X |
| 1,869,261 | 7/1932 | Jennings | 2/94 |
| 2,375,655 | 5/1945 | Irvin | 2/93 X |
| 2,448,416 | 8/1948 | Carter | 2/94 |
| 2,538,677 | 1/1951 | Ferrand | 2/51 X |
| 2,678,447 | 5/1954 | Braken | 2/94 |
| 2,853,709 | 9/1958 | Peterson et al. | 2/51 |
| 2,873,449 | 2/1959 | Herbert | 2/94 |
| 3,438,062 | 4/1969 | Dobell | 2/247 |
| 3,840,901 | 10/1974 | Eyster | 2/247 |
| 3,848,267 | 11/1974 | De Spain | 2/94 |
| 4,151,938 | 5/1979 | Barker et al. | 2/51 X |
| 4,218,781 | 8/1980 | Lieberman | 2/247 |
| 4,602,390 | 7/1986 | Morera et al. | 2/251 |
| 4,796,790 | 1/1989 | Hamilton | 224/227 X |
| 4,899,395 | 2/1990 | Spector | 2/247 X |
| 4,949,401 | 8/1990 | Kimsey, Jr. | 2/94 X |

FOREIGN PATENT DOCUMENTS

| | | | |
|---|---|---|---|
| 1067406 | 6/1954 | France . | |
| 105448 | 4/1917 | United Kingdom | 2/48 |

*Primary Examiner*—Werner H. Schroeder
*Assistant Examiner*—Jeanette E. Chapman
*Attorney, Agent, or Firm*—Reed Smith Shaw & McClay

[57] ABSTRACT

A reversible fishing garment, preferably in the form of a vest, having front and rear torsal portions which are substantially identical in construction and selectively accessible by the wearer. Both the front and the rear torsal portions include exterior flaps attached to the left and right sides thereof. Each of the flaps opens outwardly from the wearer's body to expose a plurality of easily accessible clear plastic pockets that are detachably secured to interior surfaces of the flaps. The detachability of the clear plastic pockets permits the wearer to modify the vest by fitting the flaps with pockets of predetermined sizes to suit the wearer's needs. The clear plastic of the pockets provides unhindered visibility of the fishing gear carried within the pockets. The provision of the pocket-carrying flaps on both the front and rear torsal portions of the vest dramatically increases the versatility, the number of pockets and the storage space that is available to the wearer in relation to fishing vests of conventional construction.

10 Claims, 3 Drawing Sheets

REVERSIBLE GARMENT HAVING DETACHABLE POCKETS

FIELD OF THE INVENTION

The present invention relates generally to apparel and, more particularly, to vests used in sporting activities such as fishing.

BACKGROUND OF THE INVENTION

Presently available fishing vests are typically designed with at least one pocket sewn on or into the exterior of the front torsal portion of the vest which is worn over a person's chest. Fishing vests having a plurality such pockets are most widely used because they enable the fisherman to carry numerous fishing items while fishing in a boat, wading in water, or while fishing from shore, a pier, or the like. The pockets are normally made of woven fabric, usually of the same fabric as the remainder of the vest, and are permanently attached to the vest. Because of their permanent attachment, the quantity and variety of fishing items which can be carried by the user is rather limited and is defined by the fixed size and fixed number of such pockets. Hence, the pockets may become filled by relatively modest quantities of fishing gear and, when filled, access to certain items may become quite difficult. Furthermore, as the material which forms the pockets and vest is opaque, a fisherman normally cannot visually determine the contents of the pockets.

Fishing vests having fabric pockets also pose additional problems. Typically, more than one fishing lure must be placed in a single pocket because of the storage limitations of the pocket. Thus, if a plurality of lures with several hooks are placed together in the same pocket, the lures often become snagged in the material and difficult to dislodge. Also, they may become tangled together, and, once retrieved from the pocket, one or more of the lures may become lost during untangling, especially if the fisherman is wading in water. Furthermore, because very little light reaches the interior of a fabric pocket, even when the pocket is opened, the user risks being pricked each time he attempts to retrieve a lure from the pocket.

The space limitation due to a limited number and limited size of pockets can cause other problems if lures and rubber worms are stored together in fabric pockets. For example, the color from colored rubber worms and lures with colored rubber skirts will bleed together in the same pocket. This results in the loss of the lure's and the worm's effectiveness and usually requires that the lure and worm be discarded. Moreover, the paint from painted jig heads eventually rubs off and stains the material of the pocket and/or vest. To avoid these last-mentioned problems, the lures, worms and jigs often times are carried in separate containers, such as the compartments of a tackle box, for example, which ultimately defeats the advantages provided by a vest, i.e., convenience and ready access to the fishing gear.

As a result of the limitations imposed by the size and number of their permanently attached pockets, existing fishing vests are insufficiently versatile to meet most fishermen's needs for year-round usage since different times of the year, different types of fish, and different bodies of water require lures and other gear of widely varying sizes and types. Thus, a single vest having a few permanent pockets of fixed size cannot be effectively used for conveniently and safely carrying the wide assortment of gear that a fisherman may possibly require.

A need thus exists for a fishing vest capable of providing the user with significantly greater numbers of pockets and pockets having materially greater variations in size than those of presently known fishing vests.

A further need exists for a fishing vest which would provide the user with clear visibility of the pocket contents as well as easy access thereto.

A still further need exists for a fishing vest which would be sufficiently versatile to be of practical use at different times of the year, when fishing for different types of fish, and for fishing in widely varied bodies of water.

SUMMARY OF THE INVENTION

Generally, the present invention provides a reversible fishing vest garment having front and rear torsal portions which are substantially identical in construction and selectively accessible by the wearer. Both the front and rear torsal portions include exterior flaps attached to the left and right sides thereof. Each of the flaps opens outwardly from the wearer's body to expose a plurality of easily accessible clear plastic pockets that are detachably secured to interior surfaces of the flaps. The detachability of the clear plastic pockets permits the wearer to modify the vest by fitting the flaps with pockets of predetermined sizes to suit the wearer's needs. The clear plastic of the pockets provides unhindered visibility of the fishing gear carried within the pockets. The provision of the pocket-carrying flaps on both the front and rear torsal portions of the vest dramatically increases the versatility, the number of pockets and the storage space that is available to the wearer in relation to fishing vests of conventional construction.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of a preferred embodiment thereof shown, by way of example only, in the accompanying drawings, wherein.

DETAILED DESCRIPTION OF THE INVENTION

Figure 1:
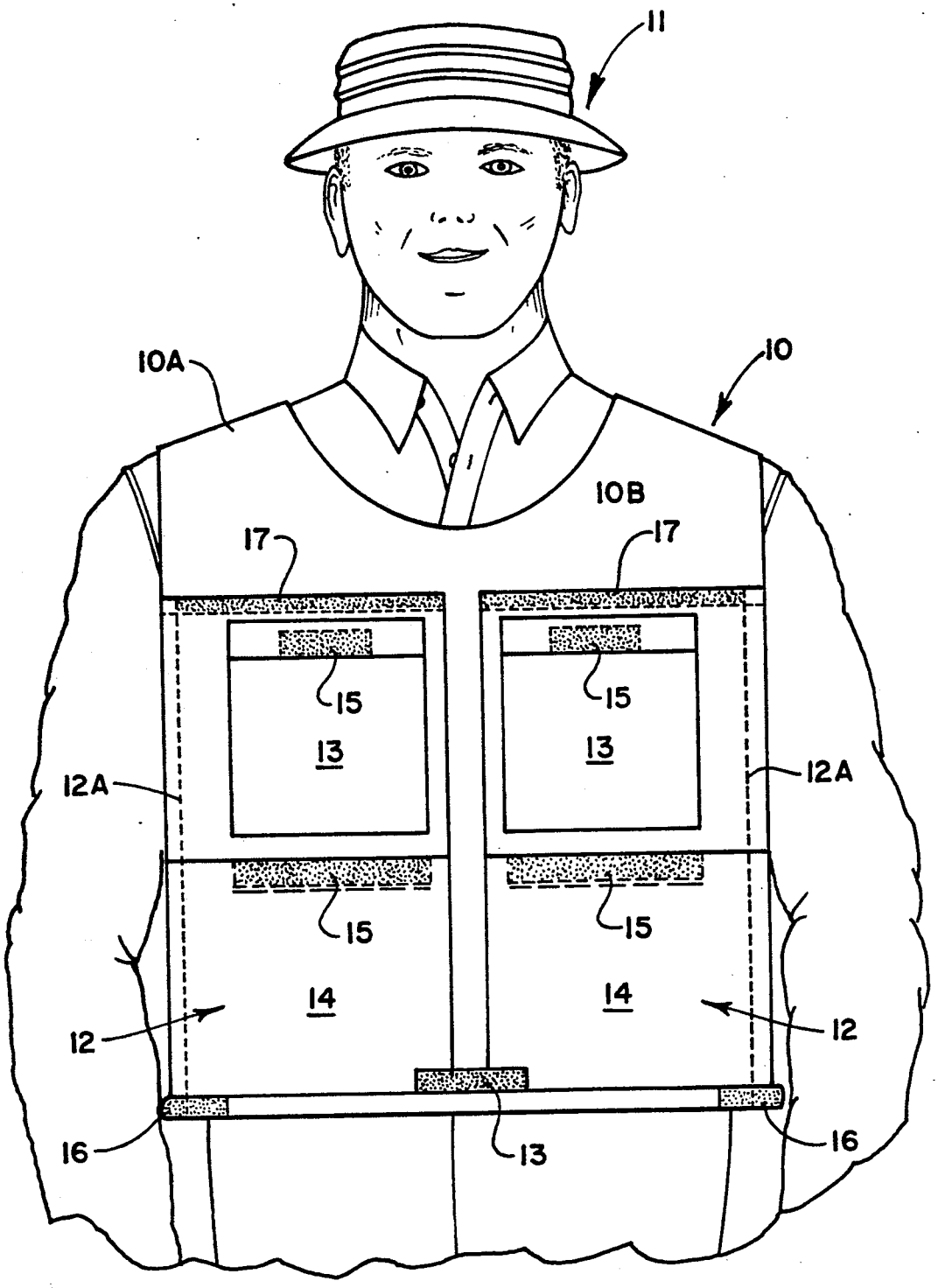
FIG. 1 is a front view of a preferred embodiment of a fishing vest constructed in accordance with the present invention; the back view of the vest, although not illustrated, being identical to the front view.

Turning to FIG. 1, there is shown a garment in the form of a reversible vest, herein designated by reference numeral 10, which represents a presently preferred embodiment of the present invention. Vest 10 is designed primarily, although not exclusively, to be used as a fishing equipment storage and carrying vest. Vest 10 preferably includes a single elongated piece of base material 10A, which may be suitably formed from any durable natural or synthetic fabric, that is provided with a neck opening 10B for permitting a user or wearer 11 to slip the vest 10 over his head such that the vest can come to rest on the wearer's shoulders as illustrated. For reasons to be described hereinafter, it is preferred, although not required, that vest 10 have no sides which would extend generally beneath the wearer's arms and permanently attach the front torsal portion of base material 10A with the rear torsal portion thereof along the sides of the wearer's torso. It will also be understood that the following description of the features of the front torsal portion of vest 10 applies also to the unillustrated rear torsal portion of the vest since, according to a preferred embodiment, the front torsal portion is identical to the rear torsal portion.

The front (and rear) torsal portions of vest 10 each have at least one and preferably two flaps 12 hingedly attached thereto so as to open outwardly and away from the user's body. Flaps 12 are preferably formed of the same fabric as base material 10A and may be permanently attached thereto as indicated by stitching 12A which extends generally vertically relative to the user's torso. It is also contemplated, however, that the flaps 12 may be releasably attachable to base material 10A by releasable mechanical fasteners such as, for example, snaps, zippers, buttons, and the like. It is also conceivable that flaps 12 may be attached to base material 10A so as to pivot outwardly along a generally horizontal axis, although this is not preferred since stored items may fall from the pockets of the flaps should the flaps become inverted relative to their positions illustrated in the Figures.

In order to achieve maximum storage capacity, flaps 12 are preferably sized and positioned to extend along base material 10A from opposite ends of the base material (which correspond to locations substantially at the wearer's waist when the vest is worn by an individual) and upwardly so as to cover substantially the full height of the user's front and rear torsal regions. To further increase storage space, it is desirable that the exterior surfaces of flaps 12 be provided with one or more pockets of conventional patch and/or pocket design as indicated by reference numerals 13 and 14. Pockets 13 and 14 are preferably held shut by Velcro® strips 15 or other suitable closure means such as snaps, buttons or zippers.

Flaps 12 are preferably held shut by Velcro® strips 17 located along the top of the interior surfaces of the flaps which engage with mating Velcro® strips 20 (FIGS. 2 and 3) secured to the base material 10A and by a Velcro® tab 18 positioned to join the lower central corners of the exterior surfaces of the flaps. Again, Velcro® strips 17 and tab 18 may be replaced by other suitable fastening means from among the types discussed above.

The lower side edges of the front and rear torsal portions of vest 10 are preferably held substantially stationary by Velcro® strips or tabs 16 releasably and adjustably connecting the front and rear portions of the vest. However, elastic strips, adjustable belts, or other similar connecting means may be used in connection with or in place of Velcro® strips 16 if desired.

As noted hereinabove, vest 10 is reversible. In particular, the vest is reversible in the sense that since both the "front" and "rear" torsal portions of the vest are identical, the user is able to quickly spin the vest around his neck and shoulders in order to position either the "front" or "rear" portion of the vest over his chest area so as to gain access to any pocket of the vest without removing the vest.

Figure 2:
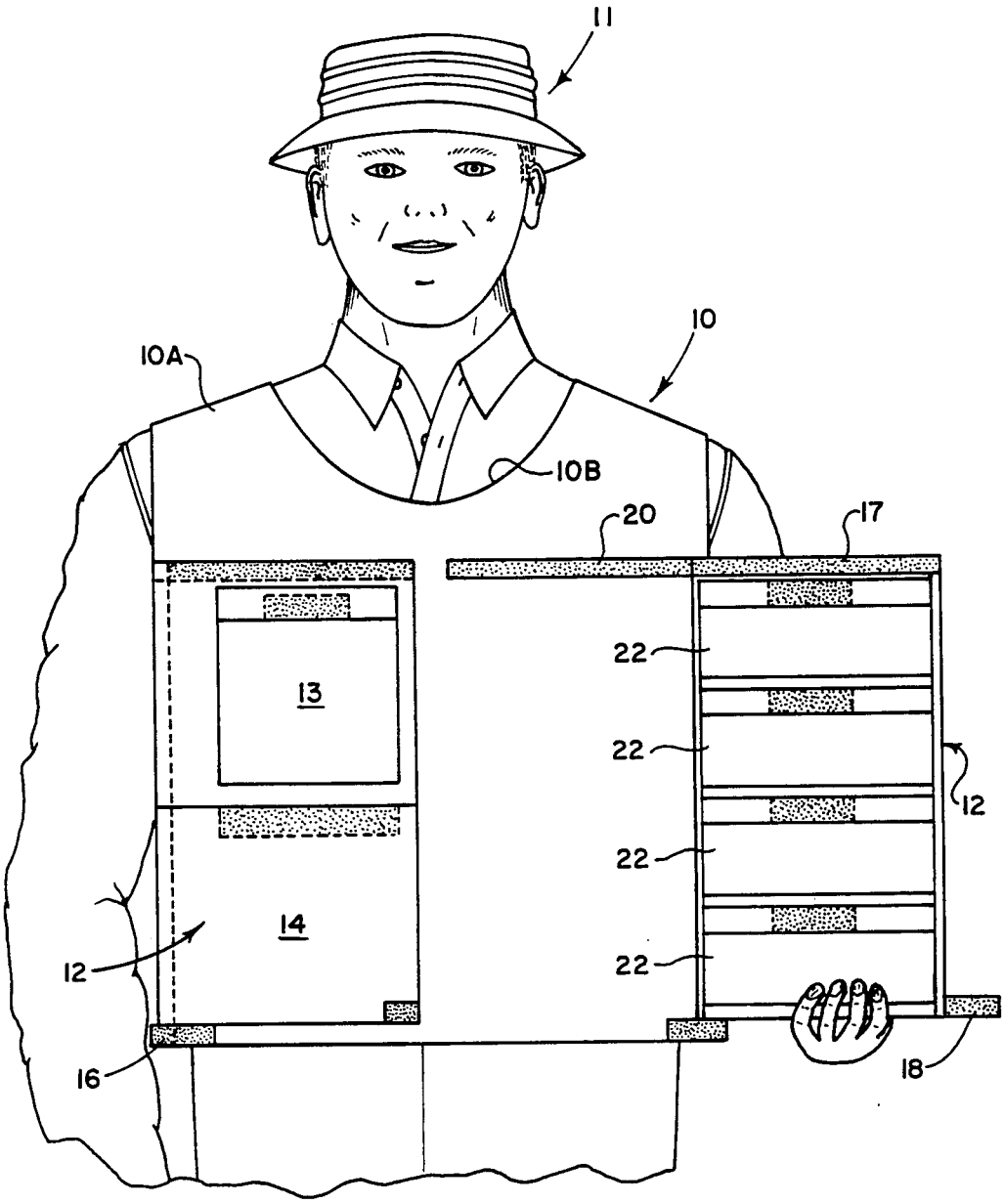
FIG. 2 also is a front view of the fishing vest of the present invention with one flap thereof shown in an open position.

In FIG. 2, one flap 12 of the vest 10 is shown in an open position thus exposing a set of storage containers in the form of clear plastic pockets 22 that, as will be described hereinbelow, are detachably secured to the interior surface of the flap. This figure clearly demonstrates the preferred hinge-like attachment of the flaps to the vest which allows the flaps to open outwardly in the direction of the side of the wearer's body so that the benefits of easy access to the pockets 22 and unhindered visibility of the contents thereof are effectively achieved.

Figure 3:
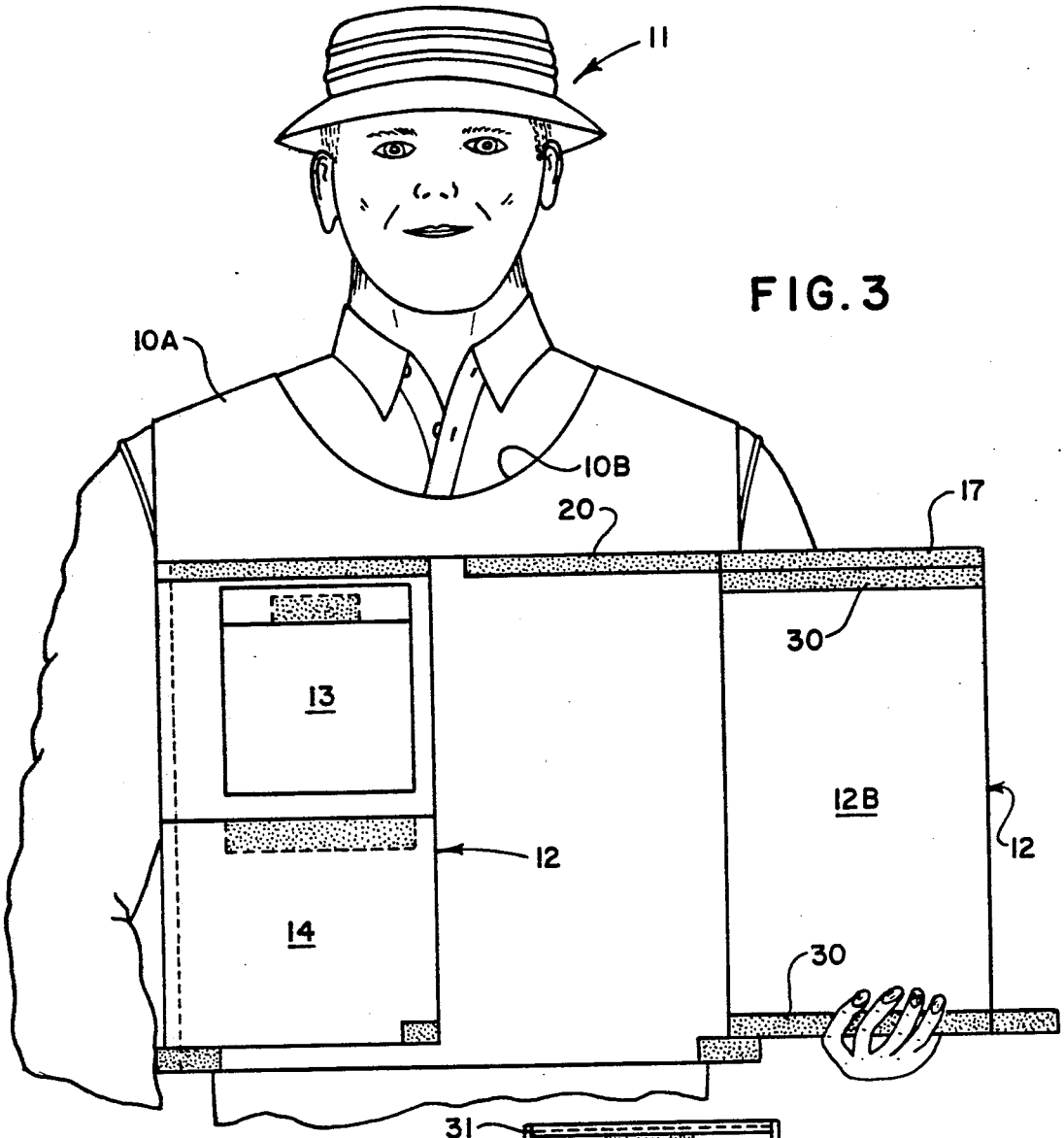
FIG. 3 is yet another front view of the fishing vest of the present invention with one flap open and a set of detachable pockets removed therefrom.

FIG. 3 illustrates the vest 10 again with one flap open but with the clear plastic pockets 22 removed to reveal the interior surface 12B of flap 12. Surface 12B is provided with at least one, or, preferably, a plurality of fastening means 30 for releasably securing the pockets 22 to the interior flap surface 12B. The preferred form of fastening means 30 is that of Velcro® strips, although zippers, buttons, snaps, or the like, could suitably be used for detachably securing the pockets 22 to surface 12B.

Figure 4:
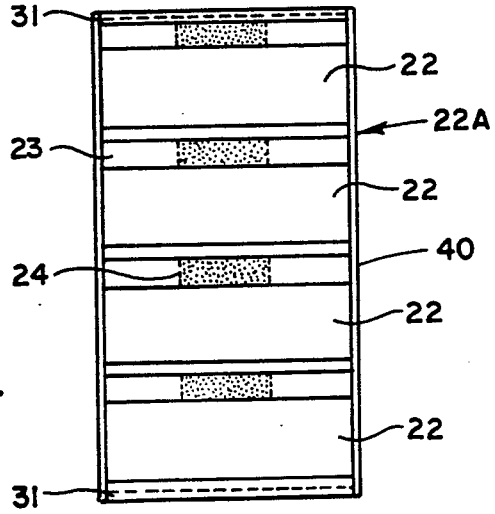
FIG. 4 depicts one embodiment of a set of detachable clear plastic pockets capable of being secured to the interior surface of the open flap shown in FIG. 3.

Although each individual clear plastic pocket 22 may be releasably secured by suitable means to surfaces 12B of flaps 12, it is in accordance with the preferred embodiment that a plurality of such pockets be arranged in sets or packets which may be attached to and removed from surface 12B as a unit, an example of which is seen in FIG. 4 and denoted by reference numeral 22A. Each of the clear pockets 22 in a set 22A are attached, as by stitching, heat bonding, adhesives, or the like, to a piece of backing material 40 having mating attachment means 31 for releasably attaching the set 22A of clear pockets to fastening means 30. The clear pockets preferably include a flap 23 which is held down by a fastener 24 which may take the form of any of the fastening means thus far described, although Velcro® is again preferred. Flaps 23 serve as a safety feature assuring that no items will fall out of the pockets 22 while the user puts the vest on or while spinning it around his neck and shoulders.

While four substantially similarly sized and shaped clear plastic pockets 22 are shown to form the illustrated pocket set 22A, any number, size and arrangement of pockets 22 may be included in such a set. Hence, the primary dimensional limitation of the pocket set 22A is the size of the interior flap surface 12B to which the pocket set is attached. In fact, it is most preferred that the vest 10 be provided with a plurality of pocket sets 22A having widely varying pocket sizes and numbers. Thus, one or more pocket sets can be quickly replaced with others to provide the user with the exact sizes, numbers and shapes of pockets required to suit the user's needs. A typical quantity of clear pockets which can be accessed by a wearer of the vest 10 of the present invention is from about 16 to 32, although less than 16 and greater than 32 are possible. Moreover, the user also has the option to wear the vest 10 with all the clear pockets 22 and/or pocket sets 22A detached for outdoor activities other than fishing, such as, for example, hunting, hiking or odd jobs.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A garment for carrying items, the garment comprising:

a quantity of fabric having an opening for permitting passage of a user's head therethrough and defining front and rear portions for covering front and rear sides of a torsal region of the user;

at least one storage container;

at least one flap hingedly attached to at least one of the front and rear portions and including an interior and an exterior surface; and a fastener for securing at least one of the storage containers to the interior surface of at least one of the flaps.

2. The garment as described in claim 1 wherein the fastener detachably secures at least one of the storage containers to the interior surface of at least one of the flaps.

3. The garment as described in claim 1 wherein at least one of the storage containers further comprises at least one pocket formed of a clear plastic material.

4. The garment as described in claim 1 wherein the storage container comprises a plurality of pockets connected together to form a set of pockets.

5. The garment as described claim 1 comprising a plurality of flaps hingedly attached to said front and rear portions.

6. The garment as described in claim 1 wherein the front portion is identical to the rear portion.

7. The garment as described in claim 6 wherein the garment is reversible.

8. The garment as described in claim 1 wherein at least one of the flaps is hingedly connected about an axis extending substantially vertically relative to the torsal region of the user.

9. The garment as described in claim 1 wherein the garment is a vest.

10. A garment for carrying items, the garment comprising:

a quantity of fabric having an opening for permitting passage of a user's head therethrough and defining front and rear portions for covering front and rear sides of a torsal region of the user;

a plurality of pockets made of clear plastic material and connected to form at least one set of pockets;

a plurality of flaps hingedly attached to the front and rear portions, each of the plurality of flaps including an interior and an exterior surface; and fastener means for enabling detachable securement of at least one of the sets of pockets to the interior surfaces of selected ones of the plurality of flaps.

* * * * *